United States Patent [19]

Breen

[11] Patent Number: 5,048,781

[45] Date of Patent: Sep. 17, 1991

[54] CONCRETE MOLD ASSEMBLY DEVICE

[76] Inventor: Edward Breen, 289 Chandler St., Tewksbury, Mass. 01876

[21] Appl. No.: 515,061

[22] Filed: Apr. 26, 1990

[51] Int. Cl.[5] ..... E04G 17/00

[52] U.S. Cl. ..... 249/219.1

[58] Field of Search ..... 248/156, 161, 172, 174, 248/287, 276, 300, 500, 505; 249/5, 6, 9, 192, 219.1, 2, 4, 216, 155

[56] References Cited

U.S. PATENT DOCUMENTS

| | | | |
|---|---|---|---|
| 955,474 | 4/1910 | Ramey | 249/6 |
| 1,028,294 | 6/1912 | Simpson | 249/4 |
| 1,496,933 | 6/1924 | Heltzel | 249/6 |
| 1,922,584 | 4/1933 | Heltzel | 249/5 |
| 2,635,320 | 4/1953 | Ornitz | 249/155 |
| 3,207,465 | 9/1965 | Papin | 249/5 |
| 3,288,426 | 11/1966 | Simpson | 249/6 |
| 3,347,514 | 10/1967 | Yates | 249/2 |
| 4,029,288 | 6/1977 | Murphy | 249/219.1 |
| 4,321,024 | 3/1982 | Terraillon | 249/8 |

FOREIGN PATENT DOCUMENTS

| | | | |
|---|---|---|---|
| 1145179 | 4/1983 | Canada | 249/219.1 |

*Primary Examiner*—Ramon O. Ramirez
*Assistant Examiner*—Robert A. Olson
*Attorney, Agent, or Firm*—Edward A. Gordon

[57] ABSTRACT

A bracket device for supporting concrete forms in a predetermined spaced relationship to each other on a supporting surface includes an elongated horizontal member and a pair of inner and outer spaced arm members depending from opposite ends of the horizontal member. Each of the pairs of inner and outer spaced arm members are adapted to engage respectively the inner and outer surfaces of the concrete form. The elongated horizontal member and inner and outer pairs of spaced arm members all lie in the same plane. In alternate embodiments the inner arm members are laterally adjustable to adjust the distance between the inner and outer arm members; the outer arm members are vertically adjustable to adjust the elevation of the bracket device; and the elongated horizontal member includes a pair of laterally adjustable sections for adjusting to the distance between the concrete forms.

7 Claims, 2 Drawing Sheets

CONCRETE MOLD ASSEMBLY DEVICE

BACKGROUND OF THE INVENTION

1. Field Of The Invention

The present invention relates to concrete forms providing a concrete receiving cavity therebetween and more particularly to a novel concrete mold assembly including a new and improved bracket device for holding the mold forms in position to define the concrete receiving cavity therebetween.

2. Description Of Prior Art

Heretofore, many types of form assemblies have been proposed or employed for the casting of concrete slabs, etc.. For example, when casting concrete slabs directly on the ground, the casting is carried out by successive or adjacent bands by using as formwork wooden forms that are nailed onto a stake driven into the ground. The setting in place of framework elements is relatively lengthy and the equipment used has not a very long life time since the driving and removal of nails deteriorates the forms.

Other types of form assemblies have included numerous moving metal parts which frequently become jammed and inoperative with the result that many manhours are lost while cleaning and lubricating the forms to place them in working order.

Other types of forms are characterized by their complicated design thereby requiring the services of highly skilled workmen to properly set up the forms.

The present state of the art is believed to be exemplified in the following U.S. Patents:

| | | |
|---|---|---|
| 955,474 | 4,321,024 | 1,496,933 |
| 1,028,294 | 3,347,514 | 3,288,426 |

Accordingly, a principle desirable object of the present invention is to overcome the disadvantages of the prior art.

Another desirable object of the present invention is to provide a novel mold assembly, and a new and improved bracket device for holding the mold forms in position.

Another desirable object of the present invention is to provide a bracket device for mold assemblies which is sturdy and durable in construction, reliable and efficient in operation, and relatively simple and inexpensive to manufacture, assemble, utilize, and maintain.

A still further desirable object of the present invention is to provide a novel bracket device for positioning a pair of oppositely disposed adjustable form members to define a concrete receiving cavity therebetween.

A still further desirable object of the present invention is to provide an adjustable bracket device for positioning a pair of oppositely disposed form members at selected distances from each other to define a concrete cavity therebetween of selected width.

An additional desirable object of the present invention is to provide a form assembly having in combination therewith an improved bracket device for securing the same to a supporting surface such as the ground.

These and other desirable objects of the present invention will in part appear hereinafter and will in part become apparent after consideration of the specification with reference to the drawings and the claims.

SUMMARY OF THE INVENTION

The present invention discloses a new and improved bracket device for supporting concrete forms having inner and outer vertical surfaces in a predetermined spaced relationship to each other on a supporting surface to thereby define a concrete receiving cavity therebetween. While the bracket device is preferably formed of metals which are preferably corrosion resistant, it may be formed of other materials such as plastics, wood, and combinations thereof. The bracket device includes an elongated horizontal member and a pair of inner and outer spaced arm members depending from opposite ends of the horizontal member. Each of the pairs of inner and outer spaced arm members are adapted to engage the concrete forms in a predetermined spaced relationship to each other. The outer arm members are provided with sufficient length for securing the concrete forms in a predetermined position with respect to a supporting surface such as a ground surface when the concrete is deposited against the inner surfaces of the forms. The inner arm members are adapted to engage a sufficient portion of the upper inner surface of the concrete forms to cooperate with the outer arm member in maintaining the concrete forms in the predetermined position. In another embodiment of the invention the inner arm members are laterally adjustable to vary the space between the inner and outer arm members so as to accommodate concrete forms of different widths. In still another embodiment of the invention, the elongated horizontal member comprises a pair of laterally adjustable sections so as to vary the length of the bracket device. In still another embodiment of the invention, the outer arm members are provided with sufficient length to extend below the concrete forms and below the ground surface.

BRIEF DESCRIPTION OF THE DRAWINGS

For a fuller understanding of the nature and desired objects of the present invention, reference should be made to the following detailed description taken in conjunction with the accompanying drawings wherein like reference characters denote corresponding parts throughout several views and wherein.

DETAILED DESCRIPTION OF PREFERRED EMBODIMENT(S)

Figure 1:
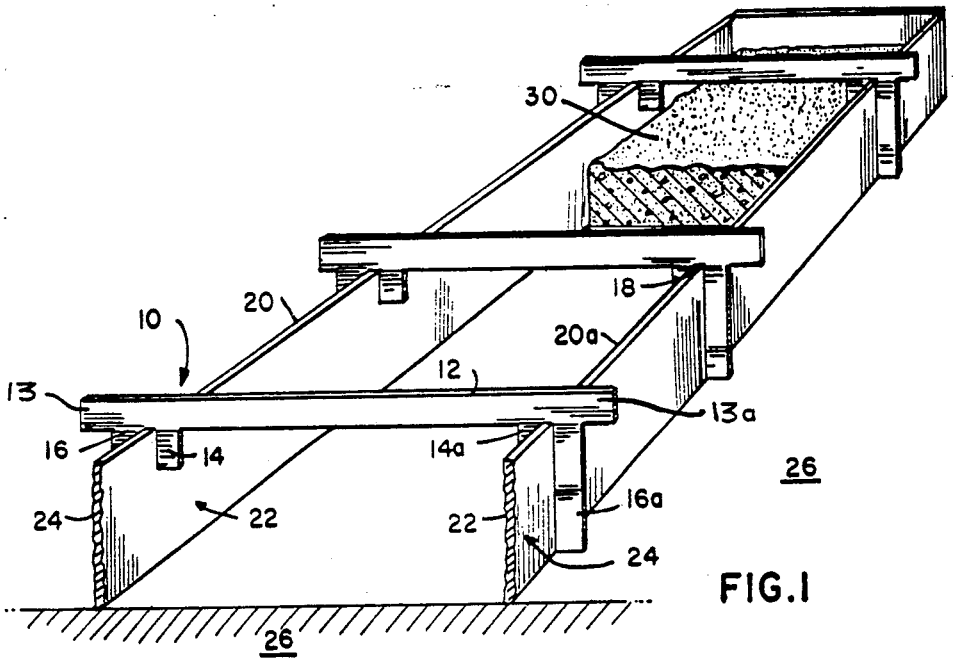
FIG. 1 is a perspective view of a mold assembly embodying the principles of the present invention during a concrete casting operation to form a band which, after juxtaposition with similar formed bands, will form a slab resting directly on the ground.
Figure 2:
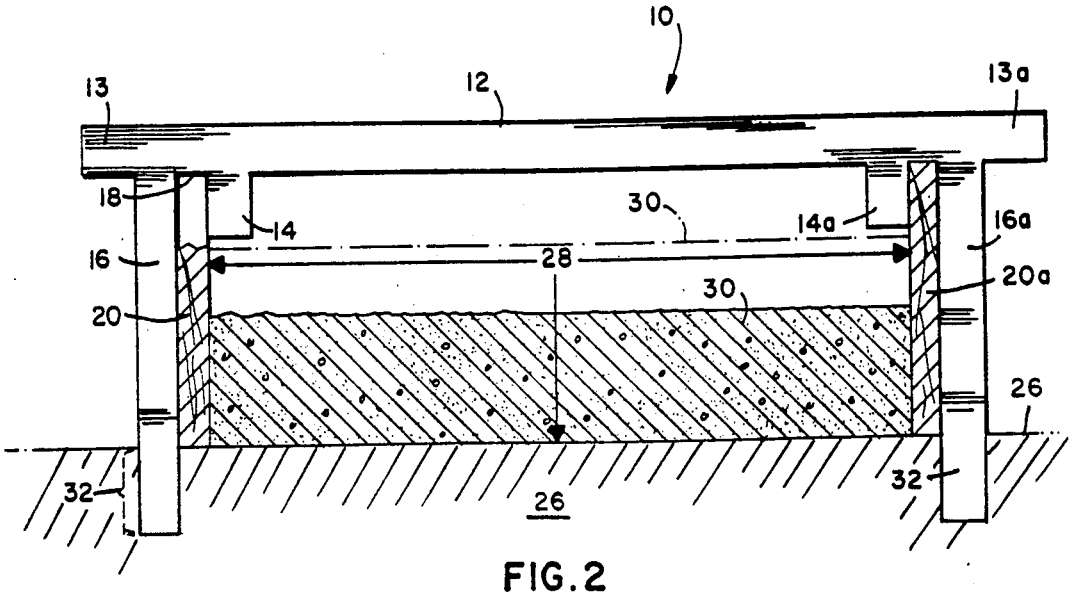
FIG. 2 is a cross-sectional view of a mold assembly similar to FIG. 1 employing a modified bracket device embodying the principles of the present invention. Also, a form member is partially broken away to illustrate the spaced relationship between adjacent pairs of arm members.

Referring now to the drawings in general and more particularly to FIGS. 1 and 2, one embodiment of the bracket device embodying the principles of the present invention is designated generally by the reference numeral 10 and comprises an elongated horizontal central member 12, inner arm members 14 and 14*a* and outer arm members 16 and 16*a* forming pairs of inner and outer arm members (14 and 16, and 14*a* and 16*a*) depending from opposite ends of the elongated horizontal member 12. As best seen in FIG. 2, each pair of inner and outer arm members are spaced apart from each other to provide a space 18 of sufficient width so that each of the pairs of arm members are able to engage the concrete form members 20 and 20*a*.

The concrete form members 20 and 20*a* each have an inner vertical surface 22 and an outer vertical surface 24 and are held in a predetermined spaced relationship to each other on a supporting surface 26, illustrated as a ground surface in FIGS. 1 and 2, to thereby define a cavity space 28 between the inner surfaces 22 and the supporting surface 26 to receive concrete 30 therebetween. The central member 12 is preferably provided with opposing end projecting sections 13 and 13*a* which extend beyond the respective outer arm members 16 and 16*a* and facilitate raising or lifting and removal of the bracket device after the concrete is formed.

While the outer arm members 16 and 16*a* ar preferably provided with sufficient length equal to the height of the forms and/or to contact the supporting surface 26 for securing the forms 20 and 20*a* in spaced upright positions when the concrete is deposited in the cavity and in contact with the inner surfaces of the forms, the length may be varied. The main requirement is that the lengths of the outer arm members 16 and 16*a* be sufficient to prevent the bottom of the form from being pushed outwardly when contacted by the concrete during filling of the cavity. In the embodiment of FIG. 1, the lengths of the outer arm members 16 and 16*a* are equal to the lengths of the form members 20 and 20*a* respectively. In the application of the invention illustrated in FIG. 2, the length of the outer arm members 16 and 16*a* are provided with sufficient additional length portion 32 so that the portion 32 of the outer arm members (illustrated in phantom) can be driven into the ground to secure the bracket members in a vertical position and the form members 20 and 20*a* in a predetermined spaced relationship to each other on the supporting surface 26 to thereby define the concrete receiving cavity 28 therebetween.

The inner arm members 14 and 14*a* are provided with a sufficient length to engage only a portion of the inner surfaces 22 of the form members 20 and 20*a* and terminate adjacent the predetermined height of the top surface 34 of the concrete 30.

In the embodiment illustrated in FIGS. 1 and 2, the elongated horizontal member 12 and opposing pairs of spaced parallel inner and outer arm members 14 and 16 and 14*a* and 16*a* all lie in the same plane.

Figure 3:
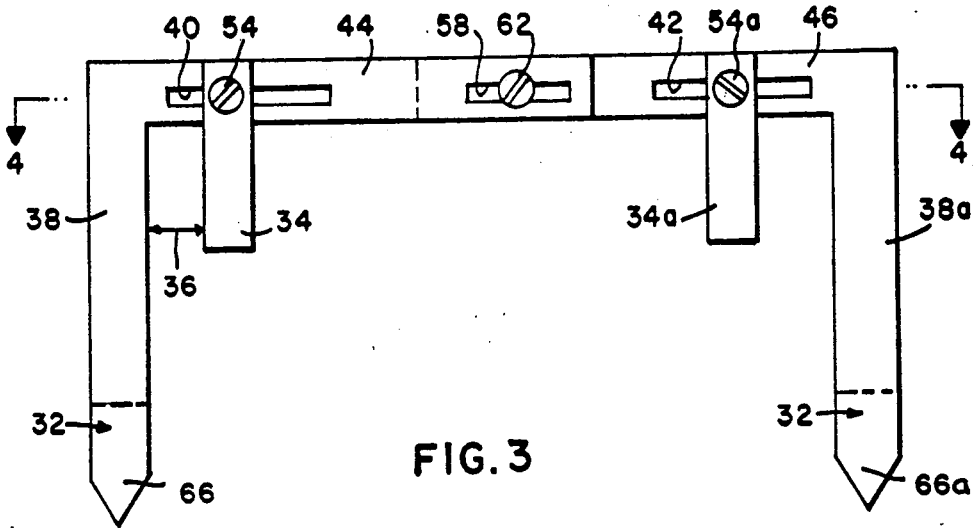
FIG. 3 is a front elevational view of an adjustable bracket device in accordance with the present invention.
Figure 4:
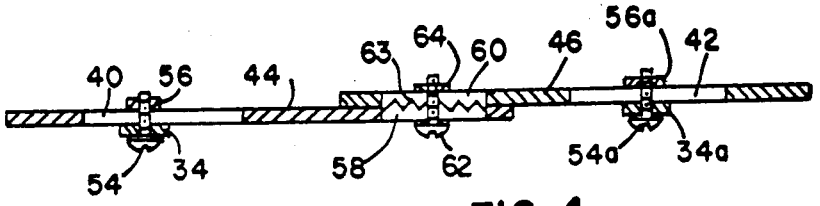
FIG. 4 is a cross sectional view taken along the line 4—4 of FIG. 3.

Referring now to FIGS. 3 and 4, there is illustrated another embodiment of the bracket device in accordance with the present invention. As shown, the inner arm members 34 and 34*a* are constructed so as to be laterally adjustable to vary the space 36 between the inner arm members 34 and 34*a* and the respective adjacent outer arm members 38 and 38*a* so as to accommodate concrete forms of different widths.

As illustrated, the lateral adjustment means for the inner arm member comprises elongated horizontal slots 40 and 42 disposed in the elongated horizontal member sections 44 and 46 adjacent the respective outer arm members 38 and 38*a*. The inner arm members 34 and 34*a* are releasably secured in the selected spaced relationship to their respective outer arm member by securing means such as bolts 54 and 54*a* and respective nuts 56 and 56*a*.

Similarly, the horizontal member sections 44 and 46 are provided with lateral adjustment means comprising adjacent horizontal slots 58 and 60 and releasable securing means illustrated as bolt and nut members 62 and 64 respectively. In this manner the bracket device is adjustable laterally to support the concrete forms in various spaced relationships to each other to define different widths of concrete receiving cavities therebetween. In the embodiment illustrated, the elongated sections 44 and 46 are provided with mating vertical serrations 63 to facilitate holding the sections in the selected lateral position. Additionally, as illustrated, when the outer arm members 38 and 38*a* are provided with additional length portions 32 (as described with respect to FIG. 2), the arm members can terminate at the lower ends 66 and 66*a* in a tapered pointed configuration to facilitate insertion of the outer arms into the ground support.

Figure 5:
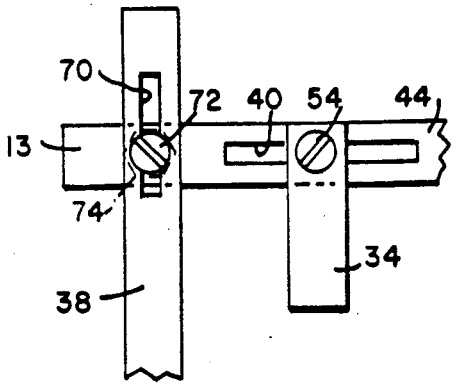
FIG. 5 is a fragmentary front elevational view of an alternate embodiment of the bracket device of the present invention.

Referring now to FIG. 5, there is illustrated an alternate embodiment of an adjustable bracket device in accordance with the present invention employing vertically adjustable outer arm members. As shown, the outer arm member 38 is formed as a separate member and provided with a vertical slot 70 adjacent the upper end of the arm to permit adjustment of the bracket to different heights above a supporting surface. A securing means for securing the arm member in a selected position relative to the horizontal section 44 is shown as a bolt member 72 carried by the section 44 and a corresponding nut 74 illustrated in phantom and attached on the other side of the section member 44. Additionally, the arm 38 is attached inwardly on horizontal section 44 to provide a projected section 13 as described with respect to FIG. 2. The opposing outer arm member 38*a* (not shown) would be constructed in the same manner.

In the use and operation of the mold assembly device of the present invention as illustrated in FIGS. 1 and 2, the 15 mold forms are set up in the proper place and distance apart to form the cement cavity when the outer arm members 16 and 16*a* of the brackets 10 are brought into contact with the ground 26 and the opposing pairs of arm members engage the form members. For most purposes the engagement of the bracket devices with the form members is sufficiently accurate to preclude any necessity for adjustment. However, in particularly fine work, or work requiring frequent adjustments in dimensions an adjustable bracket device of the present invention adjusted to the desired dimensions for the molding surfaces may be utilized.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A bracket device for supporting a pair of concrete forms having inner and outer vertical surfaces in a predetermined spaced relationship to each other on a supporting surface thereby defining a concrete receiving cavity therebetween, said bracket device comprising:

an elongated horizontal member;

a pair of outer parallel arm members depending vertically from opposite ends of the horizontal member for providing contact with the outer vertical surface of the related concrete form and supporting surface;

said outer parallel arm members including vertical adjustment means for adjusting the vertical distance between the elongated horizontal member and a supporting surface; and inner arm members depending vertically from the horizontal member in spaced parallel relationship to the inner side of each of the outer parallel arm members for providing contact with the upper portion of the inner vertical surface of a related concrete form;

said inner arm members including lateral adjustment means for adjusting the lateral distance on the horizontal member between the respective inner and outer arm members for supporting concrete forms of different widths.

2. The bracket device according to claim 1 wherein the elongated horizontal member is provided with opposing end projections extending beyond the respective outer arm members thereby providing lifting means for the bracket device.

3. The bracket device according to claim 1 wherein the bracket device is formed of metal.

4. The bracket device according to claim 1 wherein the elongated horizontal member comprises a pair of lateral sections and adjustment means to vary the length of the same so as to engage the concrete forms having a predetermined spaced relationship.

5. The bracket device according to claim 1 wherein said elongated horizontal member and inner and outer spaced parallel arm members all lie tin the same plane.

6. The bracket device according to claim 1 wherein the lower end of the outer arm members terminates in a pointed section to accommodate anchoring the outer arm members to a ground supporting surface.

7. A bracket device for supporting a pair of concrete forms having inner and outer vertical surfaces in a predetermined spaced relationship to each other on a supporting surface thereby defining a concrete receiving cavity therebetween, said bracket device comprising:

an elongated horizontal member comprising a pair of lateral sections and adjustment means to vary the length of the same so as to engage the concrete forms at a selected spaced relationship;

a pair of outer parallel arm members depending vertically from opposite ends of the horizontal member for providing contact with the outer vertical surface of the related concrete form and a supporting surface;

said outer parallel arm members including vertical adjustment means for adjusting the vertical distance between the elongated horizontal member and a supporting surface; and inner arm members depending vertically from the horizontal member in spaced parallel relationship to the inner side of each of the outer parallel arm members for providing contact with the upper portion of the inner vertical surface of a related concrete form;

said inner arm members including lateral adjustment means for adjusting the lateral distance on the horizontal member between the respective inner and outer arm members for supporting concrete forms of different widths;

said elongated horizontal member and inner and outer spaced parallel arm members all lying in the same plane.

* * * * *